United States Patent [19]

Gardner

[11] 4,043,518

[45] Aug. 23, 1977

[54] POSITIVE YARN FEEDING DEVICE

[75] Inventor: Henry C. Gardner, Norge, Va.

[73] Assignee: Dow Badische Company, Williamsburg, Va.

[21] Appl. No.: 719,781

[22] Filed: Sept. 2, 1976

[51] Int. Cl.[2] ..... B65H 59/00

[52] U.S. Cl. ..... 242/45; 66/132 T

[58] Field of Search ..... 66/132 R, 132 T; 242/46.2, 45

[56] References Cited

U.S. PATENT DOCUMENTS

| | | | |
|---|---|---|---|
| 1,592,784 | 7/1926 | Smith | 242/46.2 |
| 3,209,558 | 10/1965 | Cargill | 66/132 |
| 3,590,601 | 7/1971 | Sugiura | 66/132 T |
| 3,618,342 | 11/1971 | Wurm | 66/132 T |

FOREIGN PATENT DOCUMENTS

| | | | |
|---|---|---|---|
| 354,377 | 6/1961 | Switzerland | 242/45 |

*Primary Examiner*—Mervin Stein
*Assistant Examiner*—A. M. Falik
*Attorney, Agent, or Firm*—George F. Helfrich

[57] ABSTRACT

Yarn from a rotatable package of the type comprising a cylindrical support upon which the yarn is packaged by winding, is fed in a precise and certain manner to a source of utilization of the yarn. A drive roll is positioned in proximity to, but spaced from the yarn package, and is mounted for rotation about its longitudinal axis, the longitudinal axis of the drive roll being substantially parallel to the longitudinal axis of the yarn package. A resilient circular band having an annular cross-section is stretched over the package and the drive roll so that the band is urged against the exterior surface of both. A means is provided for driving the drive roll at a rotational velocity corresponding to the rate of consumption of the yarn, and guide means directs the yarn to the source of its utilization.

4 Claims, 1 Drawing Figure

POSITIVE YARN FEEDING DEVICE

BACKGROUND OF THE INVENTION

1. Field of the Invention

This invention relates to textiles in general, and in particular to means for the positive feeding of yarn by rolling take-off from a rotatable package.

2. Prior Art

In commercial fabrication procedures, the source of yarn supply is generally a package comprising a cylindrical spool or bobbin, upon which the yarn has been wound either cylindrically or conically by the yarn manufacturer.

For a number of applications, endwise withdrawal of the yarn from these spools or bobbins is inexpedient--viz., because of the resulting buildup of twist in the yarn, and the variations in tension theron from the top to the bottom of the package wind. By way of example, when metallic yarns of the type described and claimed in U.S. Pat. Nos. 2,129,504; 2,714,569; and 2,974,055 are being incorporated into a knited fabric produced by the wellknown circular, multi-feeder knitting machine of the rotating cylinder type, it is required that the metallic yarn be present in the fabric in a substantially flat, untwisted condition. It is of at least equal significance that when such metalic yarns are being employed in the unsupported form--i.e., without any reinforcement or wrap, as is commonly effected by a twisting with one or more non-metallic filaments, threads, or yarns-variations in tension from the top to the bottom of the package wind result in severe strains on the yarn, causing frequent breakage thereof.

Accordingly, rolling take-off of yarn from the feed package must be employed for these and like applications. Under such conditions, however, breakage of the unsupported yarn at the instant of startup of the yarn consuming source, e.g., the circular knitting machine, as well as overfeed and the resulting snarling of the yarn when the machine is stopped, are serious problems which have occupied the attention of the industry for quite some time.

Moreover, an equally serious problem is the formation of "Trapped ends" of yarn, which are segments of yarn of an outer layer of wrapping on a package which are overlapped by yarn of an inner layer of the wrapping. This condition ordinarily occurs during standard feeding (unwinding) of the yarn if the load or driving force is not evenly distributed over the entire length of the yarn package. Such is often the result, for example, when for an instant the plane of exposed yarn on the package and the surface of a roll driving it are not completely congruous.

Consequently a considerable effort has been expended over the past years to effect the feeding of yarn in a positive manner--i.e., one which is precise and certain--and numerous devices resulting from this effort have been manufactured and used. Those of the type exemplified by British Pat. No. 1,109,788 are essentially efficacious, having been found suitable for some applications, particularly those employing the circular knitting machine. However, such devices are not readily utilized in conjunction with existing equipment, a major modification therein being necessary. The cost of such modification has often delayed, and in some cases has prohibited the use of these devices.

The device of U.S. Pat. No. 3,590,601 is another apparatus for feeding yarn, especially elastic yarn, to a circular knitting machine. The apparatus, which is mounted on a circular arm placed co-axially with the center line of the circular knitting machine, includes a yarn package and a drive roller contacting the package. This drive roller is rotated in concert with the rotation of the circular knitting machine. However, in this device, the contact of the drive roller with the yarn is restricted to a combination of points forming a straight line substantially parallel to the longitudinal axis of the package spindle. As a result, there can be no movement thereof in a multitude of planes in response to instantaneous deviations of the surface of yarn from that of a perfect wind. As a consequence, the use of this and similar devices results in frequent breakage, as well as undesirable elongation of the yarn caused by the formation of trapped ends of yarn on the package.

SUMMARY OF THE INVENTION

It is therefore a primary object of the present invention to provide a simple, inexpensive, and versatile device for the truly positive feeding of yarn by rolling take-off from a rotatable package of the type comprising a cylindrical support upon which the yarn is packaged by winding.

It is another primary object of this invention to provide a device for such positive feeding of yarn, which device is readily employed in conjunction with existing yarn-utilizing equipment, such as the circular knitting machine.

It is another primary object of this invention to provide a device for the positive feeding of yarn, which device essentially eliminates: (1) breakage during startup, (2) snarling when feeding is stopped, and (3) the formation of trapped ends of yarn during the actual feeding of the yarn.

In accordance with the present invention, these objects and advantages are achieved, and the disadvantages of the prior art are obviated by the provision of a device which comprises:

A. means for supporting the yarn package and permitting rotation thereof about the longitudinal axis thereof;

B. means for guiding the yarn from the package to the source of utilization of the yarn;

C. a drive roll positioned in proximity to, but spaced from the yarn package, and mounted for rotation about its longitudinal axis, the longitudinal axis of the drive roll being substantially parallel to the longitudinal axis of the yarn package;

D. a resilient circular band having an annular cross-section, the band being stretched over the package and the drive roll so that the inner surface of the band is urged against both the exterior surface of the drive roll and the yarn on the package; and E. means for driving the drive roll at a rotational velocity corresponding to the rate of consumption of the yarn by the source of utilization of the yarn.

The device of the instant invention affords especially advantageous results when the resilient band has a substantially circular cross-section especially of diameter between about 1/16 and three-eighths inches, and when this band is urged against the exterior surface of the drive roll and the yarn on the package with a pressure of between about 0.5 and about 5 pounds per square inch.

BRIEF DESCRIPTION OF THE DRAWING

For a more complete understanding of the present invention, reference should be made to the detailed description of the preferred embodiments thereof, which is set forth below. This detailed description should be read together with the accompanying drawing, which is a perspective view schematically illustrating the construction and a means for utilizing a device for the positive feeding of yarn according to the present invention.

DETAILED DESCRIPTION OF THE PREFERRED EMBODIMENTS

Figure 1:
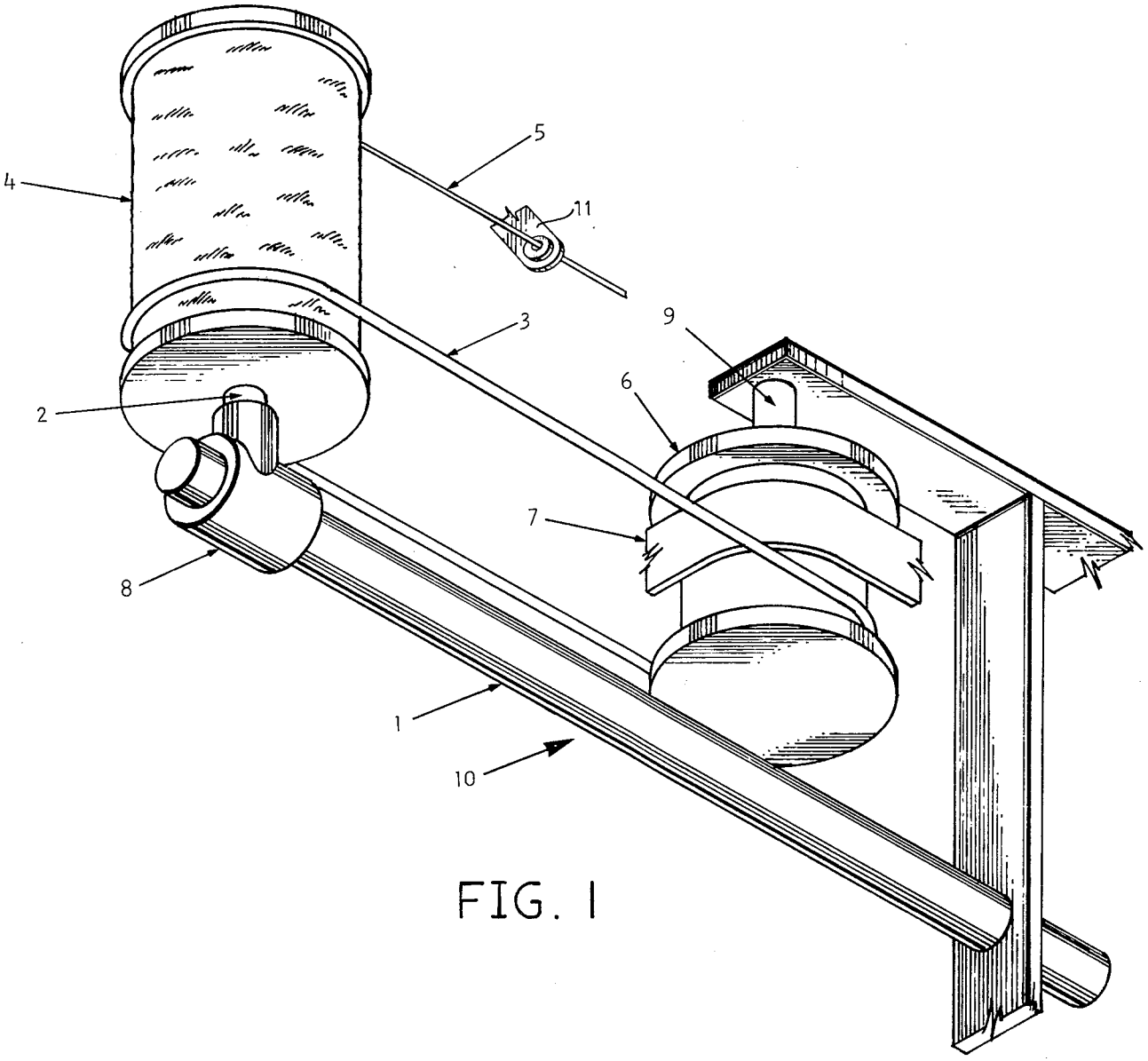

With particular reference to the drawing, there is shown a device 10 according to the present invention . Yarn package 4 comprises a cylindrical support as shown, upon which yarn 5 has been wound. Yarn package 4 is rotatably mounted about its longitudinal axis on spindle 2, which is affixed to adjustable sleeve 8. Adjustable sleeve 8 encompasses, and is slidably secured to mounting bracket 1 by means of a set screw, or the like (not shown). By means of mounting bracket 1, yarn package 4 is positioned in proximity to a source of utilization of the yarn (not shown), and yarn 5 is guided by conventional means such as a ceramic grommet 11 to this source. An important example of such a source is a needle of a circular, multi-feeder knitting machine of the rotating cylinder type, which is well-known in the art, the structure and operation of which are detailed in U.S. Pat. No. 1,775,033.

Yarn package 4 is positioned in proximity to, but spaced from drive roll 6, which is mounted for rotation about its longitudinal axis by means of spindle 9, the longitudinal axis of yarn package 4 and the longitudinal axis of drive roll (6) being substantially parallel to each other. Means for driving drive roll 6 is provided, conveniently by means of endless belt 7, which is driven at a rotational velocity corresponding to the rate of consumption of yarn by the consuming source, such as the circular multi-feeder knitting machine referred to above. Such a drive means, which is well-known and frequently used in the art, is fully explicated in U.S. Pat. No. 3,090,215, wherein particular reference is made to the details concerning its communication with the circular multi-feeder knitting machine. Under those conditions, drive roll 6 is a "cage wheel" and belt 7 is the "feeding tape" of the circular multi-feeder knitting machine. However, as is clear to those of skill in the art, other equivalent means for driving drive roll 6 may be employed when other sources of yarn consumption are utilized.

Also provided is resilient circular band 3, which is stretched over yarn package 4 and drive roll 6 so that the inner surface of band 3 is urged against the exterior surface of both the yarn on package 4 and the exterior surface of drive roll 6. It is essential that the cross-sectional configuration of band 3 be annular, and highly advantageous results are achieved when the cross-sectional configuration is substantially circular. If the cross-sectional configuration of band 3 is not annular, the device of the present invention is inoperable.

Resilient circular band 3 is conveniently fabricated from a wide variety of materials, such as natural and synthetic rubbers, chlorinated olefin polymers, etc. which are well known and widely used because of their elasticity and resiliency. The surface of band 3 should be smooth and the band must be capable of being stretched over yarn package 4 and drive roll 6 without exceeding its elastic limit. A cross-sectional, substantially circular configuration having a diameter of between about 1/16 and three-eighths inches has been found advantageous for a wide variety of applications. The position of contact of band 3 with the yarn of package 4 along the length thereof is not critical, beneficial results being achieved with contact positions anywhere along the length of yarn package 4. However, it has been found to be convenient if this contact position is slightly above the bottom flange of the yarn package 4. After band 3 is stretched over yarn package 4 and drive roll 6, adjustable sleeve 8 is employed to ensure that band 3 is urged against the exterior surface of both the drive roll and the yarn on the package, advantageously with a pressure between about 0.5 and about 5 pounds per square inch for most applications. As is understood by those of skill in the art, the pressure with which the band is urged against these surfaces will decrease as yarn is consumed, i.e., as the yarn package decreases in diameter. In any event, initial adjustment should be made so that the pressure will remain within the range of about 0.5 and about 5 pounds per square inch during the entire feeding process.

Although by no means limited thereto, devices according to the present invention are especially suitable for the positive feeding of flat ribbon yarns, elastic yarns, and unsupported metallic yarns, which are usually supplied by the yarn manufacturer as a package of yarn cylindrically wound upon a flanged tubular support--e.g., 100% metallic yarn designated CY 50 1/69 and sold under the registered trademark "LUREX" by Dow Badische Company, Williamsburg, Virginia. Positive feeding of such a yarn to each feed station of a circular multi-feeder knitting machine of the rotating cylinder type is advantageously effected, utilizing a plurality of devices according to the present invention, by driving a plurality of drive rolls 6 by means of an endless feeding tape, which is unidirectionally driven by the knitting machine, as described in detail in U.S. Pat. No. 3,090,215. The utilization of devices according to the present invention on the circular knitting machine is considered an absolutely minimal modification thereof.

The present invention may be better understood by a reference to the following examples.

EXAMPLE 1 (This Invention)

A yarn feeding device A according to the present invention was provided in proximity to a feed station of a circular, multifeeder knitting machine of the rotating cylinder type, which is well-known in the art. Yarn feeding device A was essentially identical to that pictured in the drawing of this application. A yarn guide ceramic grommet (11) was provided for guiding yarn 5 to a needle of the circular multi-feeder knitting machine. The means for driving drive roll 6 was an endless tape driven unidirectionally by the circular, multi-feeder knitting machine at a velocity corresponding to the rate of consumption of the yarn by the circular knitting machine, as explained in detail in U.S. Pat. No. 3,090,215. A smooth, resilient circular band 3 fabricated from styrenebutadiene rubber was employed having a substantially circular cross-section of about one eighth inches in diameter. The band was urged against the exterior surface of the drive roll and the yarn on the package with an initial pressure of about 3 pounds per square inch. At the conclusion of th instant run this pressure was approximately 2 ½ pounds per square inch. The yarn employed was unsupported, metallic yarn designated CY 50 1/69 and sold under the registered trademark LUREX by Dow Badische Company, Williamsburg, VA.

Utilizing yarn feeding device A, the unsupported metallic yarn was fed over a substantial period of time to a needle of the circular, multi-feeder knitting machine without any breakage or slippage of the yarn at the startup or stopping of the circular knitting machine. Moreover, there was no tendency of the yarn to sluff. No trapped ends were formed. As the yarn package became smaller, band 3 contracted correspondingly to provide a constant surface velocity and yarn feed.

EXAMPLE 2 (For Comparison)

A yarn feeding device B, not according to the present invention, was provided and was utilized in place of yarn feeding device A in a procedure otherwise identical to that in Example 1 above. Yarn feeding device B was identical to yarn feeding device A, except that band (3) had an essentially rectangular cross-sectional configuration. Employment of yarn feeding device B over the same period of time resulted in the production of trapped ends of yarn on the package, which, in turn, resulted in frequent breakage, as well as much undesirable elongation of the unsupported yarn. Device B was completely unsatisfactory as a device for the feeding of yarn by rolling takeoff from a rotatable package.

Although the present invention has been described in detail with respect to certain specific and preferred embodiments, it is apparent to those having skill in the art that variations and modifications in this detail may be effected without any departure from the spirit and scope of the invention, which is defined in the hereto-appended claims.

What is claimed is:

1. A device for the positive feeding of yarn to a source of utilization of the yarn by rolling take-off from a yarn package of the type comprising a cylindrical support upon which the yarn is packaged by winding, which device comprises:

A. means for supporting the yarn package and permitting rotation thereof about the longitudinal axis thereof;

B. means for guiding the yarn from the package to the source of utilization of the yarn;

C. an drive roll positioned in proximity to, but spaced from the yarn package, and mounted for rotation about its longitudinal axis, the longitudinal axis of the drive roll being substantially parallel to the longitudinal axis of the yarn package;

D. a resilient circular band having an annular cross-section, the band being stretched over the package and the drive roll so that the inner surface of the band is urged against both the exterior surface of the drive roll and the yarn on the package; and E. means for driving the drive roll at a rotational velocity corresponding to the rate of consumption of the yarn by the source of utilization of the yarn.

2. The device of claim 1, wherein the band has a substantially circular cross-section.

3. The device of claim 2, wherein the band is urged against the exterior surface of the drive roll and the yarn on the package with a pressure of between about 0.5 and about 5 pounds per square inch.

4. The device of claim 2, wherein the cross-sectional diameter of the band is between about 1/16 and about three-eighths inches.

* * * * *